United States Patent [19]

Stahlecker

[11] 3,990,221

[45] Nov. 9, 1976

[54] OPEN-END SPINNING MACHINE WITH AT LEAST ONE MOBILE SERVICING DEVICE

[75] Inventor: Fritz Stahlecker, Bad Uberkingen, Germany

[73] Assignees: Hans Stahlecker; Fritz Stahlecker, both of Germany

[22] Filed: Nov. 20, 1975

[21] Appl. No.: 633,807

[30] Foreign Application Priority Data

Nov. 20, 1974 Germany ..... 2454900

[52] U.S. Cl. ..... 57/34 R

[51] Int. Cl.[2] ..... D01H 13/00; D01H 9/00; D01H 3/06; D01H 1/12.

[58] Field of Search.... 57/1, 34 R, 53, 58.89–58.95, 57/78, 80

[56] References Cited

UNITED STATES PATENTS

| | | | |
|---|---|---|---|
| 3,154,909 | 11/1964 | Urano et al. | 57/53 X |
| 3,280,545 | 10/1966 | King et al. | 57/53 |
| 3,445,997 | 5/1969 | Prat | 57/34 R |
| 3,651,628 | 3/1972 | Harmon et al. | 57/53 X |
| 3,842,577 | 10/1974 | Franzen | 57/53 X |
| 3,892,062 | 7/1975 | Stahlecker et al. | 57/34 R |

*Primary Examiner*—Donald E. Watkins
*Attorney, Agent, or Firm*—Craig & Antonelli

[57] ABSTRACT

Spinning machine apparatus including a plurality of open-end spinning units arranged side-by-side and having running rails adjacent thereto for accommodating a mobile servicing device, which device effects servicing operations at individual spinning units. In order to provide accurate adjustment of the servicing device with respect to the individual spinning units, horizontally adjustable supporting elements are provided for adjusting the lateral position of the servicing device with respect to the individual spinning units.

29 Claims, 9 Drawing Figures

OPEN-END SPINNING MACHINE WITH AT LEAST ONE MOBILE SERVICING DEVICE

BACKGROUND AND SUMMARY OF THE INVENTION

This invention relates to an open-end spinning machine with a plurality of spinning units arranged side-by-side and with at least one mobile servicing device guided for movement along running (copping) rails adjacent the machine.

In order to be able to effect a partially or fully automatic thread piecing, cleaning, and/or bobbin change operation in open-end spinning machines, the latter are equipped with appropriate servicing devices. Depending on the purpose for which they are used and the given circumstances, the servicing devices are accommodated in a single moble unit or in several sliding carriages movable independently from one another.

It is conventional (DOS (German Unexamined Laid-Open application) No. 2,118,775) to equip an open-end spinning mchine with a mobile thread piecing device which can travel on two horizontally arranged copping or running rails. In this type of structure, auxiliary drives and circuits of the mobile servicing device must be connected electrically and mechanically with corresponding parts of the spinning unit which requires servicing. For this purpose, it is necessary to align the spinning unit and the servicing device for the thread piecing step with a minimum of tolerances (maximum accuracy). However, such precision; cannot be readily realized by running rails fixedly joined to the machine, especially because elastic deformations occur, due to the weight of the servicing device, at the machine and at the running rails. Additionally, there are unavoidable assembly and manufacturing tolerances between the parts of the individual spinning stations, as well as wear and tear which is unavoidable during the course of time. Unless special measures are taken to compensate for these tolerances, the operation safety of the servicing device is considerably reduced.

It is furthermore known (DOS 2,347,783, FIG. 3) to equip an open-end spinning device with a mobile servicing device which in this case is fashioned as a bobbin changing device. This servicing device is held on guide rails by means of runners provided with flanges or rims, one of these rails being arranged at the spinning device proper and the other being arranged therebelow. In this type of construction, the two guide rails are located a very great distance from the servicing site proper, namely the zone of the windup bobbin, so thata an exact positioning with respect to this servicing site is not exactly possible in this way.

Furthermore, a knotting device is known which can be moved along an open-end spinning machine (U.S. Pat. No. 3,640,059) wherein two guide rails are provided mounted above and below the spinning station at the machine frame. Also in this type of construction, deformations occur making it extraordinarily difficult to effect an exact postioning at every spinning station. Besides, the guide rails can be disposed in this way only due to the fact that in this type of structure the spinning cans with the sliver feed are disposed on the side oppositely to the spinning station proper. This is undesirable in modern open-end spinning machines, since this requires an excessive amount of space. Besides, the operation is disadvantageous, since the operator would have to operate and service each spinning station from two sides. Moreover, no machines could then be utilized which are provided with spinning units disposed side-by-side on two opposite sides.

Also, a thread piecing device is known which can be moved along a ring spinning machine (British Pat. No. 1,321,182) wherein a copping or running rail is mounted to the spindle rail and another copping or running rail is arranged essentially above the spindles. On the lower copping or running rail, the drive rollers of the serivicing device are adapted to run up, these rollers being equipped with vertical axles. Additionally, the same rail is associated with rollers having horizontal axles and being arranged on spring-supported arms; these rollers carry a flange on the side opposite to the drive rollers, so that the latter are resiliently pulled toward the copping or running rails. Also in this type of structure, the aforementioned difficulties are encountered, with respect to alignment of the servicing device in relation to the individual spinning stations which here are represented by spindle.

The present invention contemplates overcoming the above-noted disadvantages of the prior art. More particularly, the invention is based, at least in part, on solving the problem of fashioning an open-end spinning machine with a mobile servicing device so that a precise alignment or positioning of the servicing device with respect to each individual spinning unit is possible without having to make the running rails of the spinning machine of an especially great strength and without having to manufacture and mount these rails with particularly narrow tolerances.

It is contemplated by this invention to provide these just mentioned advantages without having to effect a fundamental alteration of the open-end spinning machine. In particular, the operating personnel is not to be impeded by guide rails disposed at a low level, the spinning cans are to be accommodated without obstacles, and furthermore it is to be possible to provide a machine which is equipped with spinning units on both sides.

According to a first advantageous feature of the present invention, each spinning unit is provided with supporting elements adjustably mounted thereon, on which supporting elements the mobile servicing device is guided at least horizontally to move at right angles to the traveling direction and is supported during the conductance of a servicing operation.

It has now been made possible by this just-noted feature of the present invention to align the servicing device with any spinning unit with accuracy, in spite of tolerances and any deformations which may occur due to the weight of the components, so that too heavy a machine construction is avoided. It is possible to accurately adjust the servicing device at each individual spinning station. This is advantageous above all for the horizontal spacing between the servicing device and the spinning unit, since tolerances in the vertical direction are far less problematic, as was found in practical experience. No fundamental change of the arrangement of the spinning units or the construction plan of the machine is carried out, or required so that the usual operating conditions are preserved.

According to another advantageous feature of preferred embodiments of the invention, the mobile servicing device is supported on a first running rail which extends continuously and is disposed above the spinning units and on a second running rail arranged in the zone (at the vertical level) of the service locations or sites of the spinning units. This second running rail is composed of individual sections respectively associated one each with a spinning unit and being independently adjustable horizontally and optionally vertically. This arrangement is particularly advantageous with regard to optimizing space utilization.

According to another advantageous feature of preferred embodiments of the invention, the mobile servicing device is guided vertically and horizontally on continuous running rails. Supporting elements which are independently adjustable are provided for lifting this servicing device off from these rails horizontally and at right angles to the travel direction of the mobile servicing device along the rails at each spinning unit. This feature also advantageously utilizes available space.

To permit in a simple manner a horizontal adjustment motion of the servicing device, preferred embodiments of this invention provide that the mobile servicing device is guided to be pivotable about a running rail disposed above the spinning units. A similar effect can be obtained according to another feature of the present invention by connecting a sliding unit guided along the top running rail via a joint to the servicing device.

According to another advantageous feature of preferred embodiments of the present invention, the supporting elements (for horizonal positioning and support) each are arranged at a housing of the respective spinning unit which housing is fashioned as a cover which can be pivoted away for opening the spinning unit. This pivotable housing (cover) contains a component, with respect to which a servicing device, fashioned for example as a thread piecing device, is to be especially aligned, namely the thread take-off duct. Therefore, an adjustment of this housing to change the spinning conditions does not result in an alteration of the positioning of the servicing device with regard to the thread take-off duct.

In cases where the inherent wieght of the servicing device should be insufficient to maintain the accurate position thereof during the servicing operation, the present invention contemplates providing a locking element to lock the servicing device with a counterpart at each spinning unit.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
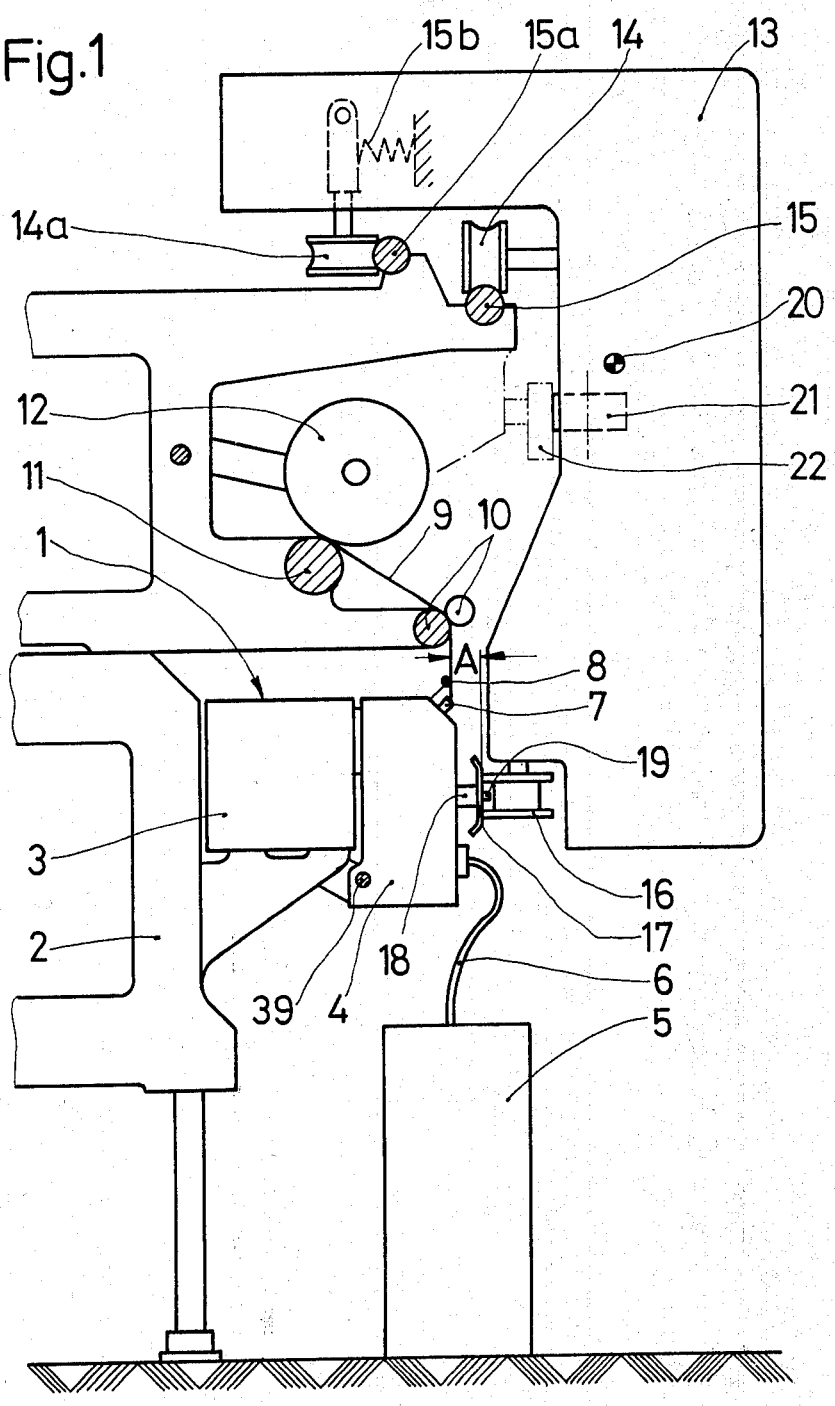
FIG. 1 is a schematic view which shows a vertical section through an open-end spinning machine with a mobile servicing device constructed in accordance with a first embodiment of the present invention.

Throughout the various drawing figures, like structures are depicted by like reference numerals.

FIG. 1 shows one-half of the side of an open-end spinning machine, which latter is equipped on both sides in mirror-image symmetry with spinning units 1. The spinning units 1 are carried by a machine frame 2. The units consist essentially of a housing 3 with a drive and a bearing for a spinning turbine and a housing 4 fashioned as a cover for a feeding and opening device. The feeding and opening device is supplied with sliver 6 withdrawn from a can 5. After the spinning operation in the turbine, the sliver is withdrawn in the form of a spun thread 9 via a thread take-off duct 7, the mouth of which is equipped with a thread regulator (broken-end detector) 8. The take-off operation takes place via a pair of take-off rolls 10; these rolls 10 being followed by a bobbin 12 driven by a winding or lap roll 11. The housing 4 carrying the thread take-off duct 7 is fashioned as a lid for the fixedly arranged feeding and opening means and carries merely a portion of a fiber feed duct leading to the spinning turbine and the thread take-off duct 7. However, this housing can also be constructed so that the feeding and opening device is arranged within the housing. The housing 4 is supported to be pivotable about an axle 39 arranged underneath the housing 3 and extending in the longitudinal direction of the machine, so that the spinning unit can be opened by pivoting this housing 4 out of the way.

Figure 2:
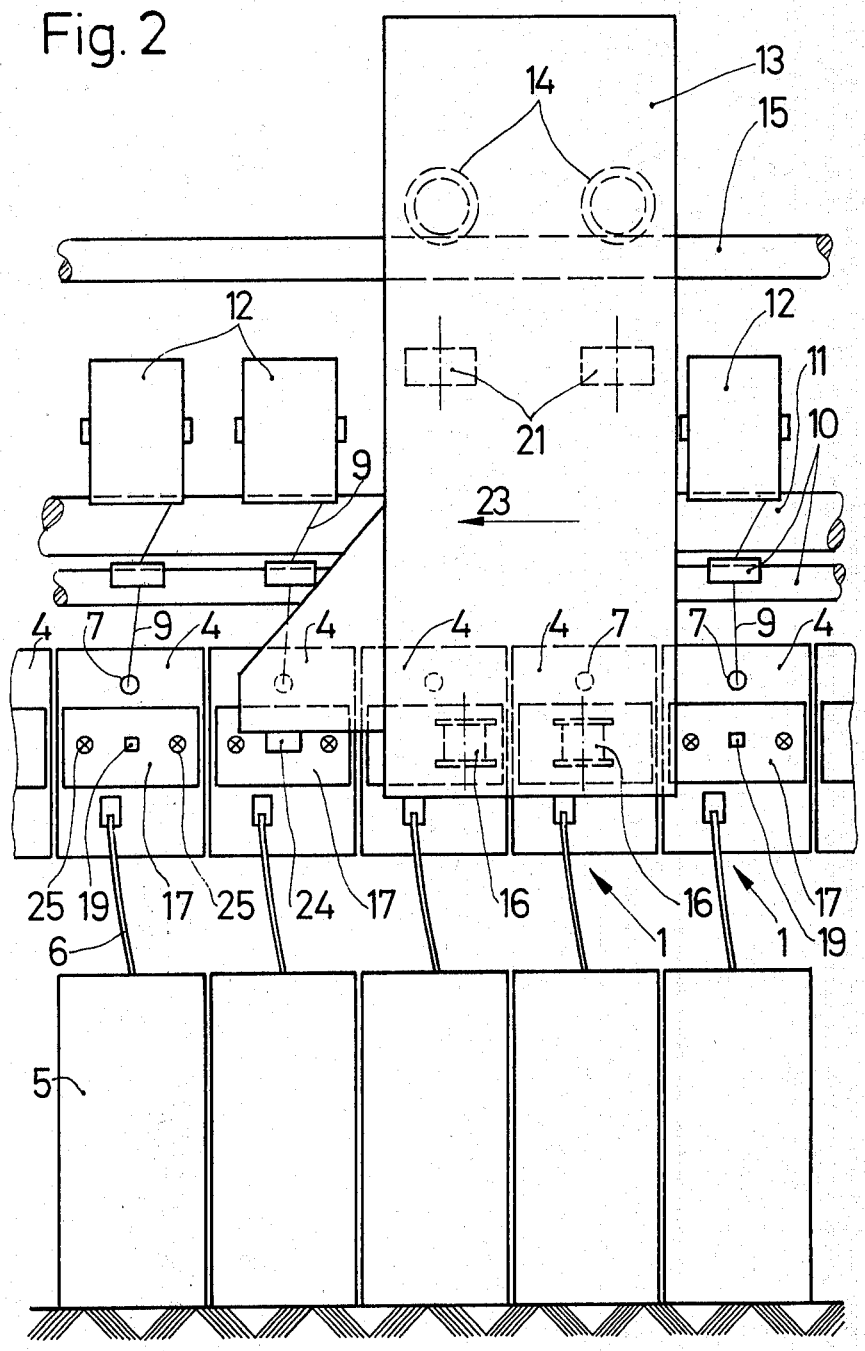
FIG. 2 is a schematic front view of the spinning machine according to FIG. 1.

At least one mobile servicing device 13 is provided for the open-end spinning machine which serves, in a manner which is conventional and thus not explained in detail, for effecting, as necessary, a cleaning and/or thread piecing and/or changing of the bobbins 12. For this purpose, a servicing unit is contemplated which can execute all of these functions. It is, of course, also contemplated by the invention to provide an individual unit for each of these functions, which is moved along the machine independently of the other units. The servicing device 13 runs with at least two rollers 14 on a copping or running rail 15 mounted appreciably above the spinning units 1, i.e. above the bobbins 12, to the machine frame 2. This running rail 15 extends in the longitudinal direction of the machine (FIG. 2). At least one of the rollers 14 is provided with a drive, not shown. To safely absorb the experienced horizontal forces also in the upper zone, the embodiment of FIG. 1 provides an additional copping or running rail **15*a* on which runs at least one roller 14*a* provided with a vertical axle, the latter being mounted pivotably by means of a spring 15*b*** having a strong bias.

A second support for the servicing device 13 is provided by way of at least one runner or roller 16 rotatably arranged about a vertical axis and serving only for the absorption of horizontal forces. This runner 16 is associated with a copping or runing rail attached to the open-end spinning machine, which is composed of individual sections 17. These sections 17 are mounted directly to the housing 4 of each spinning unit by way of supporting elements 18 adjustable in the horizontal direction and preferably containing a spring element. These sections 17 are dimensioned in length so that they are associated with respectively one spinning unit 1 and take over the horizontal guidance of the servicing device 13 only in the zone of this spinning unit 1. The adjusting elements 18 make it possible to exactly set at each spinning unit 1 individually the spacing A of the bearing (contact) surface of the running rail composed of the sections 17 from the thread take-off duct 7 and thus the horizontal position of the servicing device 13 with respect to the thread taake-off duct 7. Accordingly, it is possible to compensate in a simple manner for the tolerances produced during the manufacture and assembly of the spinning units 1 so that the same operating conditions exist at each spinning station for the servicing device 13. The servicing device 13 is fashioned in such a way, and the running rail 15 and the rail composed of the sections 17 are arranged in such a manner that the servicing device 13 exerts, due to its inherent weight with the center of gravity 20, a force component in the direction toward the sections 17. Consequently, the servicing device is held securely even during the servicing operation.

An only minor distance above the level of the bobbin 12, the servicing device 13 is equipped with at least one further roller 21 supported in the zone of the open-end spinning machine on a copping or running rail 22 illustrated in dot-dash lines, there being no spinning units arranged in this zone. This is the zone at the two machine ends where the servicing device passes from one side of the machine to the other.

It can be seen from FIG. 2 that the sections 17 are provided with adjusting screws (setscrews) 25 making it possible to adjust the sections in the horizontal direction. During this step, the servicing device 13 is pivoted respectively about its upper running rail 15 which operation is favored by the configuration of the running rail 15 and the runners or rollers 14. In the illustrated embodiment, the rail 15 is fashioned as a cylinderical rod. The runners 14 have corresponding recesses in the form of profiling. It is also contemplated to utilize a different sliding unit and a different copping or running rail, and to connect this sliding unit hingedly with the remaining part of the servicing device 13 about an axis extending in the traveling direction. It can furthermore be seen from FIGS. 2 and 3 that the runner or runners (roller or rollers) 16 are arranged, as seen in the traveling direction, at such a mutual spacing that they are all disposed on only one of the sections 17 in the servicing position, while they are supported on adjacent servicing devices in the illustrated intermeidate positions during the travel motion.

Figure 3:
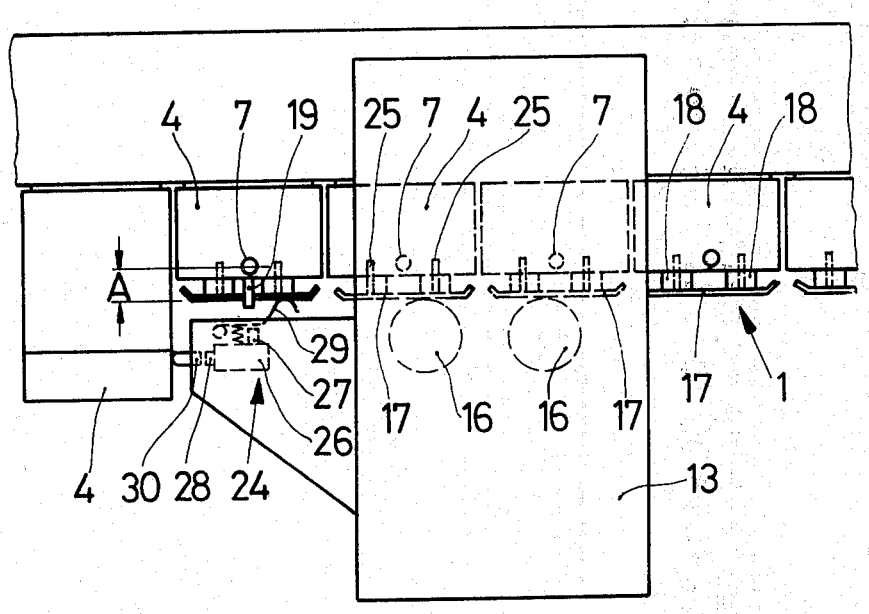
FIG. 3 is a schematic top view of the spinning machine according to FIGS. 1 and 2.

FIGS. 1 to 3 illustrate further that a plunger 19 is disposed in the zone of the sections 17 of the lower copping or running rail. This plunger 17 is moved out of the respective section 17 in case of a thread breakage and indicates the presence of such thread breakage to the servicing device 13. The movement of the plunger 19 is controlled by the thread regulator sensor 8. This plunger 19 can be detected, for example, by means of a testing probe 24 movable together with the servicing device 13. According to the embodiment of FIG. 3, this testing probe comprises a sensor 29 which is pressed elastically against the sections 17. When a plunger 19 projects from a section, the sensor 29 is displaced, whereby the sensor actuates a contact 27 of a switch 26, by means of which the carriage of the servicing device 13 is turned off and braked in such a manner that the servicing device is adjsuted in the traveling direction exactly with respect to the spinning unit to be serviced. This switch 26 can furthermore be associated with a sensor 30 pointing into the traveling direction, this sensor 30 cooperating with a further switch 28. With the aid of this sensor, the servicing device 13 can be arrested when it abuts the folded-up housing 4 of a spinning unit. In this connection, the design is such that an immediate arrest without a slowing-down action is ensured in the latter case.

Figure 4:
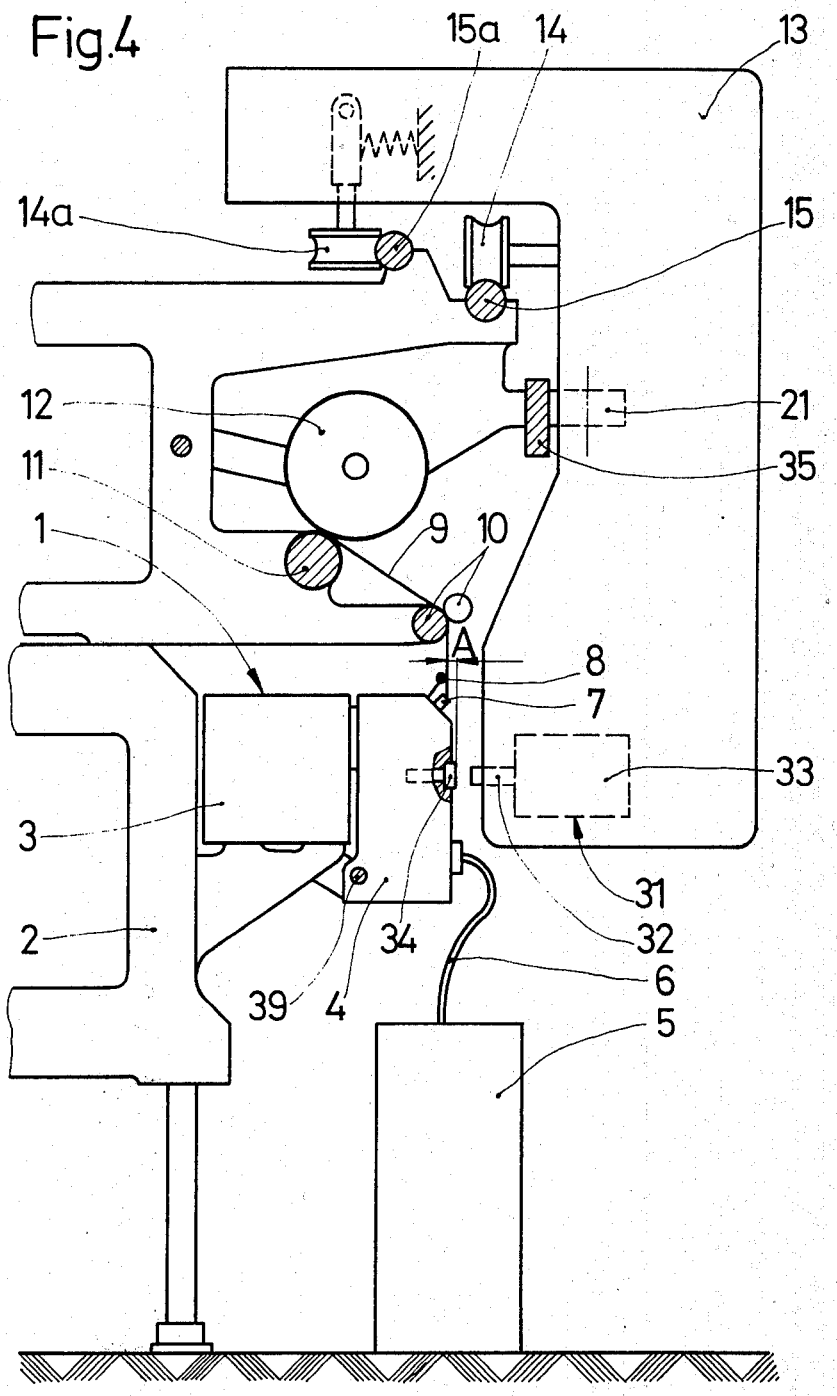
FIG. 4 is a schematic view which shows a vertical section through an open-end spinning machine with a mobile servicing device constructed in accordance with a second preferred embodiment of the invention.
Figure 5:
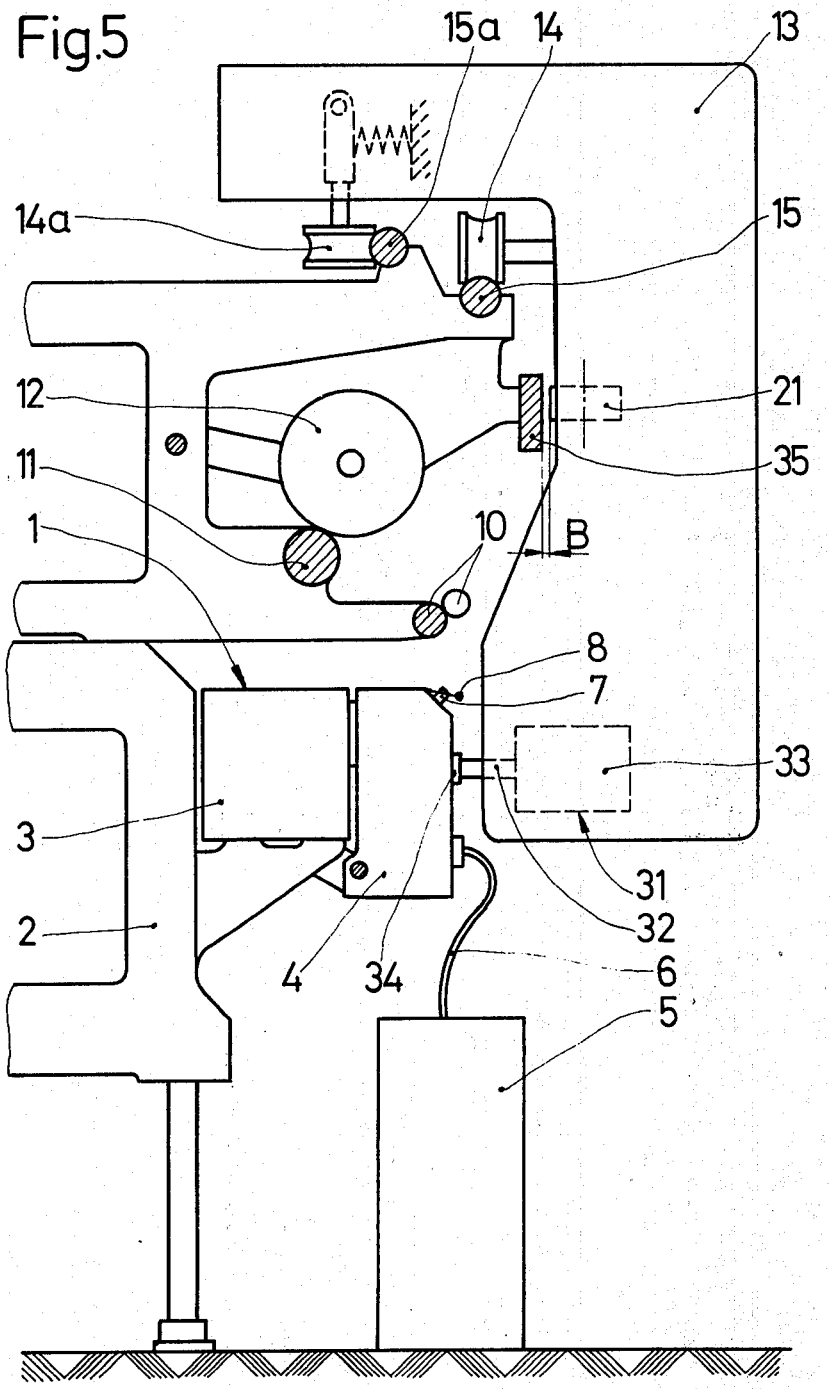
FIG. 5 is a view corresponding to FIG. 4 through the same open-end spinning machine wherein the servicing device is in its operating position.

The spinning units 1 and the machine frame 2 of the embodiments of FIGS. 4 and 5 correspond to the embodiment of FIG. 1. For the mobile servicing device 13, running rails 15 and **15*a* extending in the longitudinal direction of the machine and disposed at a high level are provided, on which runners or rollers 14 and 14*a* are traveling. The rail 15 and the runners 14 here again take over essentially the vertical support of the servicing device 13. The horizontal support is taken over in the lower zone by one or more runners or rollers 21 with vertical axles; arranged at the level of the bobbin 12; these runners abut against a rail 35 of the machine frame. Here again, the design can be so that the servicing device 13, due to its inherent weight, is in secure contact with ite runners 21 agains the running rail 35. The running rail 35** likewise extends in the longitudinal direction of the machine.

To provide an individual adjustment of the servicing device on each spinning unit 1, the embodiment of FIG. 4 provides that each housing 4 of the feeding and opening device is equipped with an adjustable supporting element 34, the spacing A of which can be adjusted exactly with respect to the thread take-off duct 7. In opposition to these supporting elements 34, a lifting device 31 is accommodated in the servicing device 13, which is fashioned, for example, as a lifting magnet (solenoid) 33 provided with a plunger 32. In case of servicing, the plunger 32 is extended, so that the entire servicing device is pivoted outwardly about the rail 15, wherein the runners 21 are lifted off the rail 35 by the distance B (see FIG. 5). Since the supporting elements 34 are all set at the same distance A with respect to the take-off ducts, the servicing device 13 assumes an identical position at all spinning units.

Figure 6:
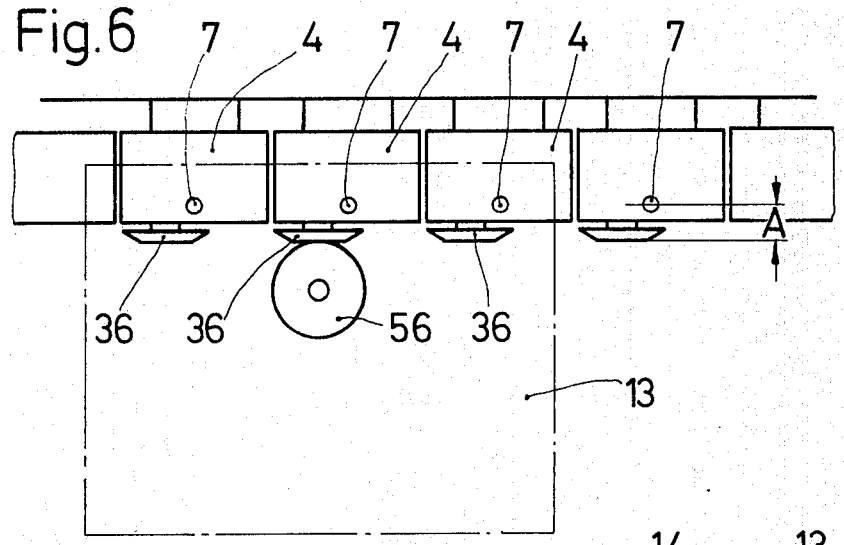
FIG. 6 is a schematic top view of a spinning machine with a mobile servicing device constructed in accordance with a third preferred embodiment of the invention.
Figure 7:
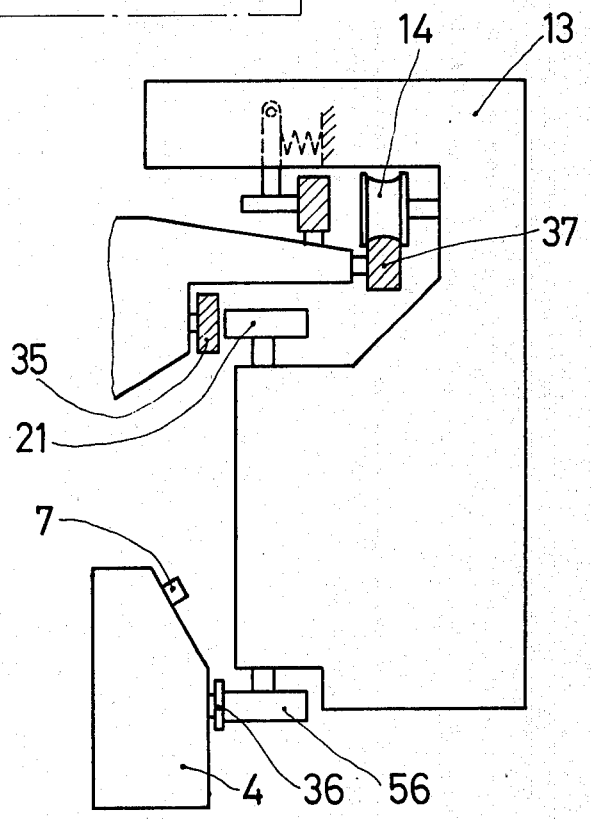
FIG. 7 is a schematic vertical partial sectional view of the spinning machine in FIG. 6.

The embodiment of FIGS. 6 and 7 corresponds in principle to the embodiment of FIGS. 4 and 5, since also in this construction two rails 37 and 35 extending in the longitudinal direction of the machine are provided. One rail absorbs the vertical forces and the other essentially only horizontal forces. On the rail 37 which absorbs the vertical forces, the topside being rounded, correspondingly profiled runners or rollers 14 are operated. On rail 35, one or more runners or rollers 21 with vertical axles are operated in normal procedure. In this embodiment, the running rails and the runners are arranged so that the vertical support is displaced farther toward the outside up to approximately the point of gravity, not shown. This point of gravity, though, must still be outside of a vertical plane extending through the rail 37. Each housing 4 of the spinning units is provided with a rail-type supporting element 36 adjustably arranged at the housing 4. In opposition to these supporting elements 36, runners 56 with vertical axles are arranged on the servicing device; these runners take over, in the zone of the spinning units, the horizontal support of the servicing device and lift the runners 21 off the rails 35.

The type of structure according to FIGS. 4 and 5 has the advantage as compared to the type of construction according to FIGS. 6 and 7 that, in the normal case, the servicing device is constantly guided on the two rails and travels without vibrations. A horizontal pivoting out of the traveling position takes place only for a servicing operation on a certain spinning unit, after the servicing device has been arrested. A similar action is obtained by fashioning the rail-type supporting elements 36 of the embodiment according to FIGS. 6 and 7 so that they are disposed, in the normal case, in a position retracted into the region of the walls of housing 4, from which they are then lifted if a thread breakage or the like is detected at the respective spinning unit, sensed by a thread regulator arranged in the zone of the thread take-off duct. This embodiment would, of course, require an increased expenditure, since the activating and switching elements required for this purpose would have to be mounted to each spinning unit. If such expenditure is acceptable, then the presence of a servicing need can also be detected by the servicing device by way of the position of the rail-type supporting elements.

Figure 8:
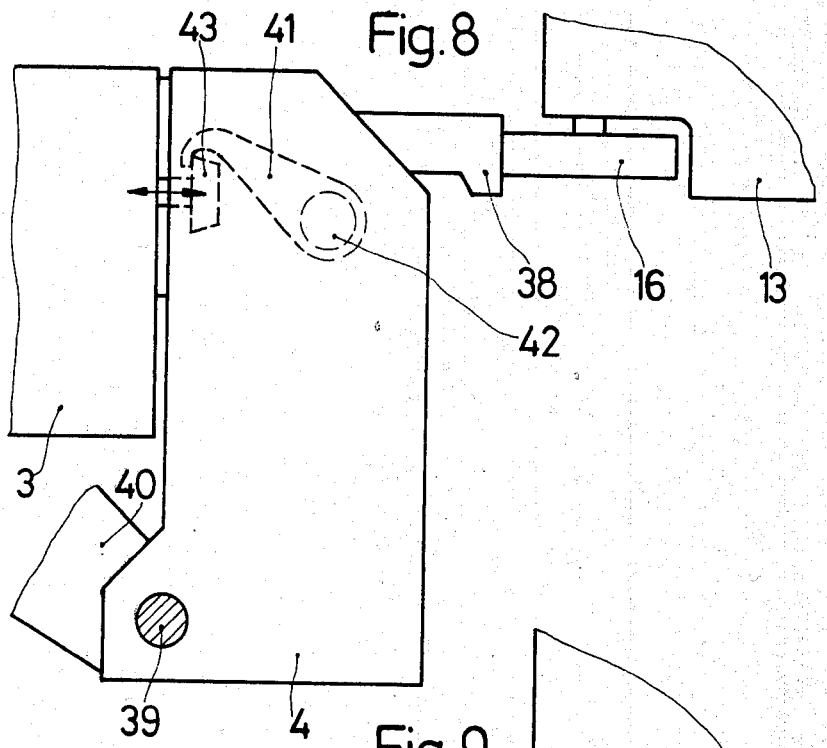
FIGS. 8 and 9 are schematic vertical partial sectional views of spinning machines with mobile servicing devices constructed in accordance with respective fourth and fifth embodiments of the invention.

FIG. 8 shows an embodiment wherein a servicing device 13 is supported in the horizontal direction with a runner or roller 16 on a running rail 38 by means of a vertical axle. This rail 38 is rigidly mounted to the housing 4 of the feeding and opening device, this housing being pivotably disposed on a holder 40 with an axle 39. The pivotable housing 4 is held by means of a lever 41 pivotable about an axle 42 at a locking element 43 of the housing 3. This locking element 43 is mounted to be adjustable in the horizontal direction, so that by displacing the locking element 43, an adjustment of the copping rail 38 in the horizontal direction is also effected; this rail is composed of individual sections, similarly as in the construction of FIGS. 1 to 3.

Figure 9:
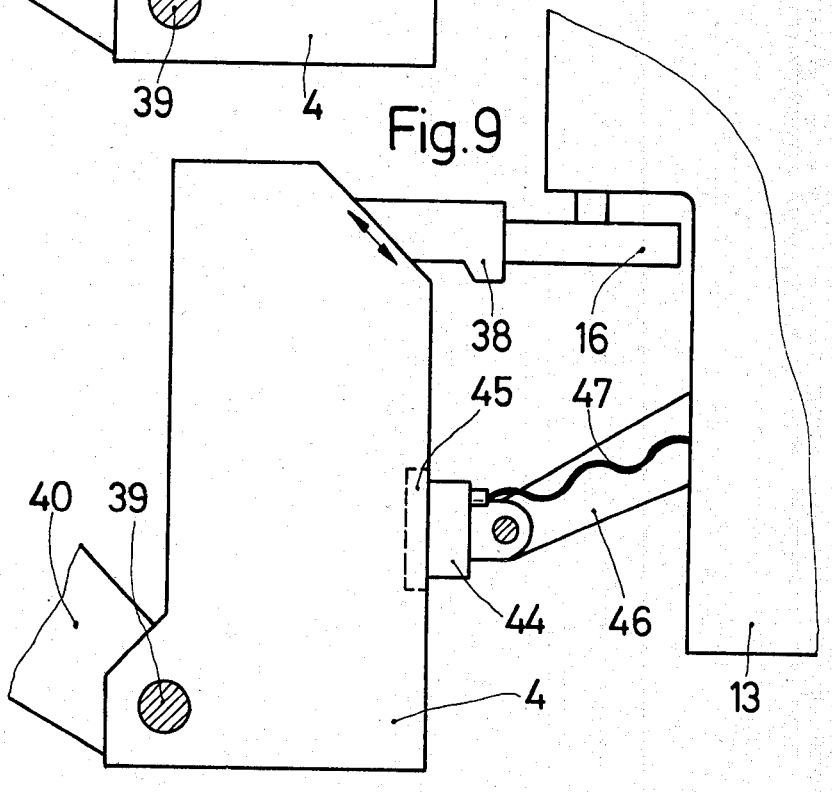

In the embodiment of FIG. 9, the sections of the running rail 38 are attached adjustably on an inclined surface of the housing 4, so that by shifting along this inclined surface, a very sensitive adjustment of the horizontal spacing of the operating surface of the running rail 38, for example with respect to the thread take-off duct 7 can be effected. In the construction of FIG. 9, the servicing device 13 is additionally provided with a magnet 44 disposed on a rocking lever 46, a counterpart 45 of the housing 4 being associated with this magnet. The electromagnet 44 is supplied with current via an electric line 47 from the servicing device 13. It is possible with the aid of this electromagnet 44 to lock the servicing device 13 with respect to the housing 4 so that its runner 16 is in secure engagement with the running rail 38 and cannot lift off therefrom during a servicing operation. This locking action, which of course can also be effected by mechanical locking means, is suitable if the force component toward the running rail 38 effected by the inherent weight of the servicing device 13 may not be entirely sufficient.

In the above-described embodiments, the starting point of the consideration has always been that the servicing device 13 and/or the supporting elements guiding the servicing device in the zone of each spinning unit are positioned or aligned with respect to the thread take-off duct. This is true, above all, in case of an automatic thread piecing operation after a thread break has occurred. Of course, an alignment with respect to another location, e.g. toward the windup bobbin or toward a cleaning aperture or the like is also posssible without difficulties, if this adjustment is desirable for a corresponding servicing device. In this connection, the position of the pivot axis of the servicing device 13, in the illustrated embodiments the elevated running rail 15 or 37, is of importance as well. If such pivot axis is arranged at least approximately vertically above the adjustable supporting elements, then only minor horizontal force components result during the adjustment process.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Spinning machine comprising:

a plurality of spinning units arranged side-by-side, running rail means attached to the machine, at least one mobile servicing device movably guided on said running rail means for movement to respective servicing positions at respective ones of said spinning units, and supporting element means for adjustably supporting the mobile servicing device at each of the respective spinning units in a direction transverse to the traveling direction of said mobile servicing device along said running rail means, whereby the relative position of said mobile servicing device and respective spinning units to be serviced can be readily and accurately adjusted.

2. Spinning machine according to claim 1, wherein said spinning units are open-end spinning units.

3. Spinning machine according to claim 1, wherein said supporting element means includes separate adjustable support members at each spinning unit, said support members being selectively engageable with said mobile servicing device to move the same laterally of said traveling direction along said running rail means when said mobile servicing device is in a servicing position at a respective spinning unit.

4. Spinning machine according to claim 1, wherein said running rail means includes a first rail which extends continuously and is disposed above the spinning units and a second rail disposed in the zone of portions of the spinning units to be serviced, said second rail being composed of individual sections respectively associated with a spinning unit, wherein said supporting element means includes adjusting means for independently moving said individual sections of said second rail laterally of said traveling direction.

5. Spinning machine according to claim 4, wherein said traveling direction extends substantially horizontally, and wherein said adjusting means includes means for moving said individual sections horizontally and optionally vertically.

6. Spinning machine according to claim 1, wherein said running rail means includes a first continuous running rail which supports the mobile servicing device in the vertical direction and a second continuous running rail which supports the mobile servicing device horizontally, and wherein said supporting element means includes means for lifting said mobile servicing device off from said second rail horizontally and at right angles to said traveling direction at each of the respective servicing positions.

7. Spinning machine according to claim 6, wherein said means for lifting said mobile servicing device includes a support element member at each of said spinning units which is directly engageable with said mobile servicing device during lifting of same off from said second rail.

8. Spinning machine according to claim 7, wherein said support element members are rail-type members at each of the spinning units, and wherein the servicing device is provided with abutment surface means which face and a but said rail-type members when said mobile servicing device is in a respective servicing position.

9. Spinning machine according to claim 8, wherein said abutment surface means are rollers.

10. Spinning machine according to claim 8, wherein said abutment surface means are cams.

11. Spinning machine according to claim 6, wherein said means for lifting said mobile servicing device includes a lifting mechanism carried by said servicing device.

12. Spinning machine according to claim 7, wherein said means for lifting said mobile servicing device includes a lifting mechanism carried by said servicing device.

13. Spinning machine according to claim 1, wherein said mobile servicing device and said supporting element means are configured and disposed so that the inherent weight of the mobile servicing device exerts a force component on the supporting element means when in a servicing adjusted position, whereby said mobile servicing device is maintained in its adjusted position during servicing operations.

14. Spinning machine according to claim 4, wherein said mobile servicing device and said supporting element means are configured and disposed so that the inherent weight of the mobile servicing device exerts a force component on the supporting element means when in a servicing adjusted position, whereby said mobile servicing device is maintained in its adjusted position during servicing operations.

15. Spinning machine according to claim 6, wherein said mobile servicing device and said supporting element means are configured and disposed so that the inherent weight of the mobile servicing device exerts a force component on the supporting element means when in a servicing adjusted position, whereby said mobile servicing device is maintained in its adjusted position during servicing operations.

16. Spinning machine according to claim 1, wherein said running rail means includes an upper running rail which is disposed above the spinning units, and wherein said mobile servicing device is guided to be pivotable about said upper running rail to accommodate lateral adjustment of the position of said mobile servicing device at said spinning units.

17. Spinning machine according to claim 4, wherein said running rail means includes an upper running rail which is disposed above the spinning units, and wherein said mobile servicing device is guided to be pivotable about said upper running rail to accommodate lateral adjustment of the position of said mobile servicing device at said spinning units.

18. Spinning machine according to claim 6, wherein said running rail means includes an upper running rail which is disposed above the spinning units, and wherein said mobile servicing device is guided to be pivotable about said upper running rail to accommodate lateral adjustment of the position of said mobile servicing device at said spinning units.

19. Spinning machine according to claim 13, wherein said running rail means includes an upper running rail which is disposed above the spinning units, and wherein said mobile servicing device is guided to be pivotable about said upper running rail to accommodate lateral adjustment of the position of said mobile servicing device at said spinning units.

20. Spinning machine according to claim 1, wherein each spinning unit includes a housing cover which is pivotably openable, and wherein said supporting element means includes support element members arranged on and movable with said housing cover.

21. Spinning machine accordint to claim 1, further comprising a locking element at said mobile servicing device and a counterpart at each of said spinning units, said locking element being lockingly engageable with respective ones of said counterparts to lock said mobile servicing device in respective servicing positions.

22. Spinning machine according to claim 4, further comprising a locking element at said mobile servicing device and a counterpart at each of said spinning units, said locking element being lockingly engageable with respective ones of said counterparts to lock said mobile servicing device in respective servicing positions.

23. Spinning machine according to claim 6, further comprising a locking element at said mobile servicing device and a counterpart at each of said spinning units, said locking element being lockingly engageable with respective ones of said counterparts to lock said mobile servicing device in respective servicing positions.

24. Spinning machine according to claim 1, wherein the mobile servicing device is equipped with a lateral abutment switch which, when abutting against an obstacle, especially a pivoted-away housing of a spinning unit, arrests the servicing device by cutting off the drive and/or by actuating its brake.

25. Spinning machine according to claim 1, wherein in zones not equipped with spinning units, especially the end zones of the spinning machine, at least one running rail taking over the horizontal support of the servicing device is additionally provided.

26. Spinning machine according to claim 1, further comprising means for automatically detecting a servicing need at respective spinning units and means for automatically stopping said mobile servicing device at a respective servicing position in response to a detected servicing need.

27. Spinning machine according to claim 26, wherein said means for automatically detecting a servicing need is a thread breakage detector.

28. Spinning machine according to claim 1, wherein said mobile servicing device includes means for at least one of cleaning, thread piecing, and bobbin changing at the respective spinning units.

29. Spinning machine according to claim 1, wherein said mobile servicing device includes rollers, at least one of which is driven to propel the mobile servicing device, said rollers being supported and guided by said running rail means.

* * * * *